US005692627A

United States Patent [19]

Feng

[11] Patent Number: 5,692,627

[45] Date of Patent: Dec. 2, 1997

[54] NURSING BOTTLE WITH AN AIR VENT OF THE BOTTOM THEREOF

[76] Inventor: Le-Jang Feng, 1Fl., No. 22-10, Lane 50, Tien Mu E. Rd., Taipei, Taiwan

[21] Appl. No.: 677,219

[22] Filed: Jul. 9, 1996

[51] Int. Cl.[6] ..... A61J 9/04; A61J 9/08

[52] U.S. Cl. ..... 215/11.5; 215/11.4; 215/902; 220/DIG. 27

[58] Field of Search ..... 215/11.1, 11.5, 215/11.4, 902; 220/DIG. 27; 137/513.5, 515.7

[56] References Cited

U.S. PATENT DOCUMENTS

| | | | |
|---|---|---|---|
| 533,726 | 2/1895 | McBride | 215/11.5 |
| 2,753,068 | 7/1956 | Robinson | 215/11.4 |
| 2,760,664 | 8/1956 | D'Amico et al. | 215/11.5 X |
| 2,907,485 | 10/1959 | Lunden | 215/11.1 |
| 3,355,047 | 11/1967 | De Sole | 215/11.1 |
| 3,768,683 | 10/1973 | Van Den Bosch | 215/11.5 |
| 4,311,245 | 1/1982 | Maffei | 215/11.5 |
| 4,339,046 | 7/1982 | Coen | 215/11.5 |
| 4,723,668 | 2/1988 | Cheng | 215/11.5 |
| 4,928,836 | 5/1990 | Wu et al. | 215/11.5 |
| 5,499,729 | 3/1996 | Greenwood et al. | 215/11.5 |

FOREIGN PATENT DOCUMENTS

| | | | |
|---|---|---|---|
| 9007320 | 7/1990 | WIPO | 215/11.5 |

*Primary Examiner*—Sue A. Weaver
*Attorney, Agent, or Firm*—Pro-Techtor International

[57] ABSTRACT

The device offers an improved structure of bottom inlet nursing bottle, wherein an opening at the bottle bottom is provided with a unilateral diaphragm which can open only inward but close outward so as to help the baby suck milk comfortably together with the air introduced into the bottle from the bottle bottom. A protective plate is provided on the outer bottom surface and is able to open or close. An air inlet regulating device is provided on the protective plate and able to regulate the size of the air inlet so as to meet the different inlet volume of different babies. The air inlet can be closed so as to prevent the milk in the bottle from seeping out when preparing the milk and to prevent the warm-keeping water and the impurity in the water from infiltrating into the bottle when warming the milk.

1 Claim, 6 Drawing Sheets

NURSING BOTTLE WITH AN AIR VENT OF THE BOTTOM THEREOF

BACKGROUND OF THE INVENTION

1. Field of the Invention

The present invention is related to a structure of nursing bottle and particularly to an improved structure of bottom inlet nursing bottle which is able to let the baby suck the milk comfortably, smoothly and easily in line with the bottom inlet manner, to regulate the size of air inlet for regulating inlet volume, and to prevent the foreign matter or warming-keeping water (when warming the nursing bottle) from entering into the bottle and prevent the milk in the bottle from seeping out since it is equipped with a function of blockade.

2. Description of the Prior Art

The nursing bottle is general comprises a bottle body, a bottle cap and a nipple. The nipple is nested in the bottle cap and the nipple tip is projected over the bottle cap to be sucked by the baby; the bottle cap and the bottle body are threaded onto each other through the preset inner and outer threads thereon. When the baby holds the bottle nipple wiith its mouth and sucks the milk in the nursing bottle (or other milk product therein), the external air has to be supplemented into the bottle so that the bady can suck the milk therein smoothly.

The structure of nowadays conventional nursing bottle is shown in FIG. 1, wherein the outer thread 11 of bottle body 1 and the inner thread 21 of bottle cap 2 are designed to be a few coarse threads with long pitch, so the external air enters into the nursing bottle through the clearance between these inner and outer threads.

However, the present conventional nursing bottle in fact has the following defects during use as shown in FIGS. 2 and 3:

1. When the baby holds the nipple and sucks the milk in the bottle with its mouth, the external air enters into the bottle through the clearance between the threads of bottle cap 2 and bottle body 1. But the said clearance is rather small and subject to a plurality of zigzag blockade of these threads, the air supply volume and speed are smaller than the baby's natural sucking power and speed, so the baby's sucking milk is rather painstaking, it sucks less milk volume and its milk sucking time is rather long.

2. The baby will remain suck the milk by virtue of its sucking instinct although its milk sucking is painstaking. As a result of its continuous sucking and the external air supply lagging behid its sucking speed, the interior of bottle become vacuum and the nipple becomes flat as shown in FIG. 3. Under the counter sucking power of the said vacuum, the baby has to use its larger sucking power so as to overcome the said counter sucking power, so its sucking is more painstaking and difficult, and in the circumstances of its unduly using power for sucking but sucking no milk, its mouth will be hurt and deformed and it will be tired of sucking and lead to its spiritual vexation and unset.

3. Therefore, the nurse will often recommend the baby's parent: when to feed it milk with the nursing bottle, the nursing bottle has to be rotated so as to prevent the nipple from becoming flat, and during feeding it, the nursing bottle has to be drawn out from its mouth frequently for releasing pressure. But suck a operation seems rather troublesome, and sometimes the feeder will also forget the operation of rotating and drawing the bottle, and furthermore, when to draw the nursing bottle out from the baby's mouth and then put it into its mouth, it does not accept the nipple occasionally.

4. Since the external air supply into the nursing bottle is through the clearance of threads between the bottle body and the bottle cap, the foregoing clearance is close to the nipple, and at most time during feeding the baby, the nursing bottle is inclined but the milk volume is at a level higher than the clearance, namely, the external air is mixed into the milk from the middle end of milk and close to the nipple, the air gradually entering into the bottle is geadually mixing with the milk therein to generate bubbles 22 and close to the nipple, so at thte same time of the baby sucking milk, it will suck the air in the bubbles in quantities to cause its vomiting milk.

In view of the above, some manufacturer designed and offered a bottom inlet nursing bottle, for instance, U.S. Pat. No. 4,401,224 as shown in FIG. 4, which has an opening 13 at the bottom of bottle body 1 to be covered with a lid 4, an arbor hole 43 and a plurality of air holes 44 are provided in the central part of lid 4, a central arbor 46 of a unilateral diaphragm 45 can be inserted in the arbor hole 43 so that the diaphragm 45 is disposed inside the lid 4 to cover the inner side of air holes 44, namely, to close these air holes 44 from interior. The unilateral diaphragm can only open inward but close outward, so it can open inward unilaterally in response to the baby's saucking power. When the baby sucks milk through the nursing bottle nipple, the flow volume of sucked milk leads to an attractive force to open the unilateral diaphragm inward at the bottle bottom, the external air with equivalent volume enters into the bottle through the unilateral diaphragm to keep the bottle interior and exterior in a state of even pressure so as to help the milk flow smoothly and let the baby get the milk flow volume as expected in response to its natural and comfortable sucking power. Therefore, the baby can easily and comfortably suck milk and its mouth will not be hurt and deformed for its unduly sucking and friction with the nipple.

However, during practical use of the nursing bottle disclosed in the said U.S. Pat. No. 4,401,224, the following defects remain:

1. When to add the boiled water and milk powder into the bottle for preparing milk, the bottle body has to be shaken up and down so as to evenly mix both boiled water and milk powder. However, the exterior of air holes 44 at the bottom of lid 4 communicates with the external space directly, so when the bottle body is quickly shaken up and down, the air flow in the external space will be introduced inward to generate an action of convection which will accordingly turn the unilateral diaphragm 45 open inward as shown in FIG. 5, the external air will also enter into the bottle along the air holes 44, and the milk in the bottle will seep out from the bottle along the air holes not instantly closed by the unilateral diaphragm 45, namely, when preparing milk in the bottle, there is a phenomenon of milk seeping out.

2. It is difficult to control the baby's appetite which sometimes is low, and it is regretful to throw away the milk which the baby cannot drink off, so as a rule, the bottle with surplus milk therein is disposed in a milk warming device 5 to keep it warm as showm in FIG. 6 for the baby's drinking if necessary. Hoewver, the actions of warm-keeping water 51 pressure and temperature difference will lead the warm-keeping water and the ompurity in the said water to gradually infiltrate into the bottle thru the air holes 44 at the bottle bottom, then the fluid volume in the bottle will be more as shown by the dotted lines, indicating that the originally well-prepared milk concentration is diluted and unfavorably affected in the aspects of milk quality and health which will spoil the baby's health.

3. The diameter of air holes 44 on the lid 4 is fixed without change and there is no other device to regulate the size of said diameter, so the intake volume thereof is constant but cannot vary with the baby's growth.

SUMMARY OF THE INVENTION

In view of the forgoing defects of conventional nursing bottle, the present invention is designed through improvement to offer a structure of bottom inlet nursing bottle, wherein an opening at the bottle bottom is provided with a unilateral diaphragm which can open only inward but close outward so as to help the baby suck milk comfortably together with the air introduced into the bottle from the bottle bottom, a protective plate is provided on the outer bottom surface and able to open or close, an air inlet regulating device is provided on the protective plate and able to regulate the size of the air inlet so as to meet the different inlet volume of different babies, and the air inlet can be closed so as to prevent the milk in the bottle from seeping out when preparing the milk and to prevent the warm-keeping water and the impurity in the said water from infiltrating into the bottle when warming the milk.

DETAILED DESCRIPTION OF THE PREFERRED EMBODIMENTS

Figure 1:
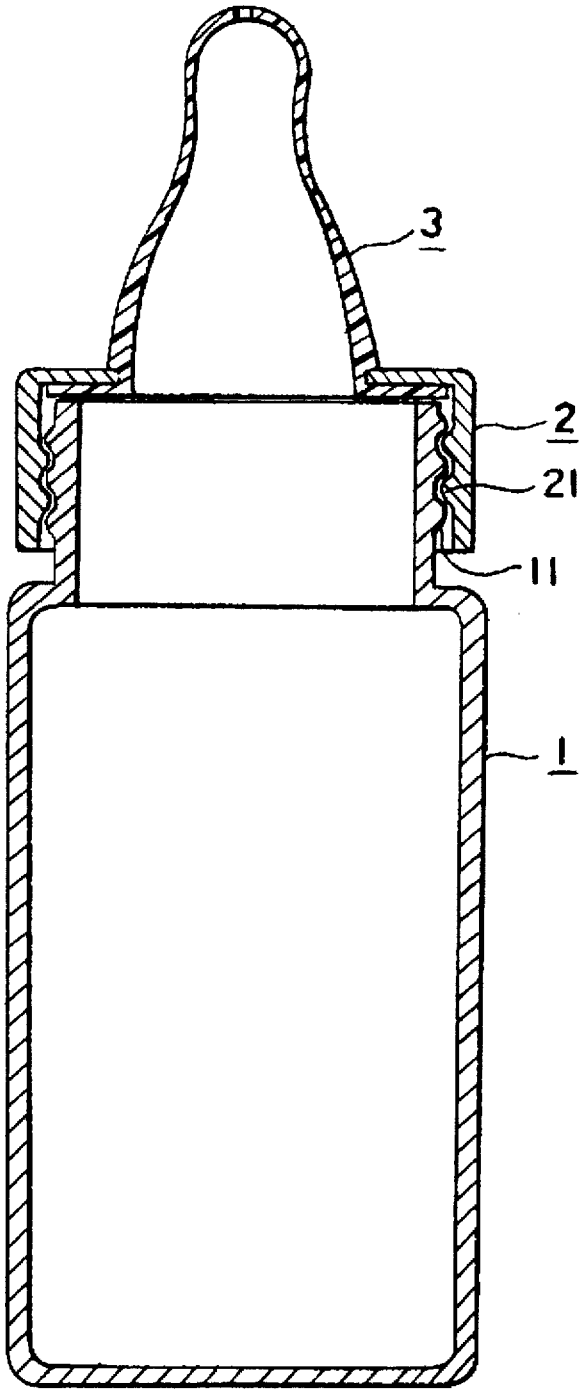
FIG. 1 (Prior Art)
FIG. 1 is a section view of the conventional nursing bottle.
Figure 2:
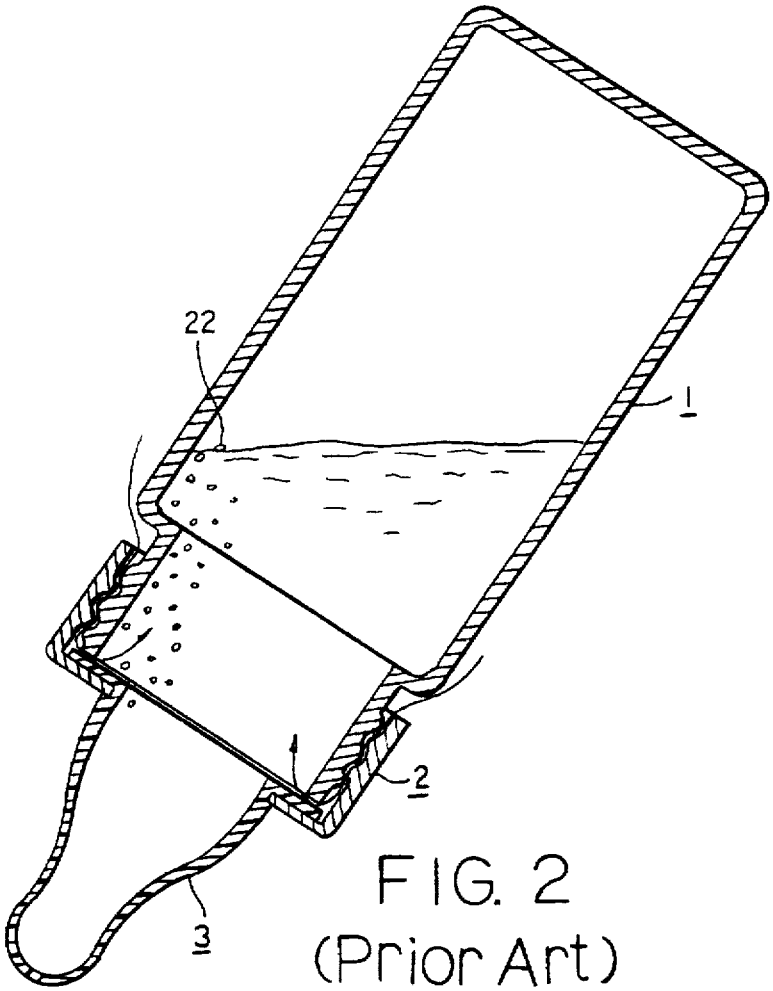
FIG. 2 (Prior Art)
FIG. 2 is an optional view of using the conventional nursing bottle.
Figure 3:
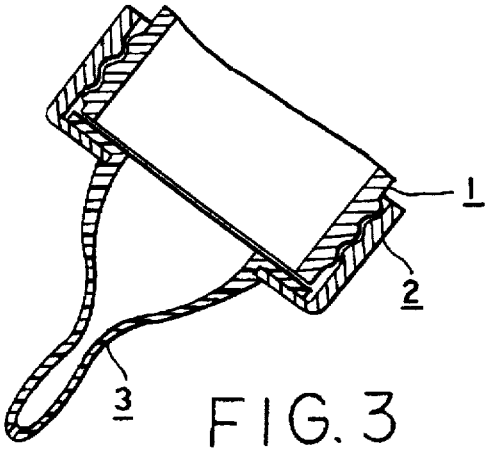
FIG. 3 (Prior Art)
FIG. 3 is an optional view of using the conventional nursing bottle wherein the nipple becomes flat for short supply of air leading to a vacuum interior of the bottle.
Figure 4:
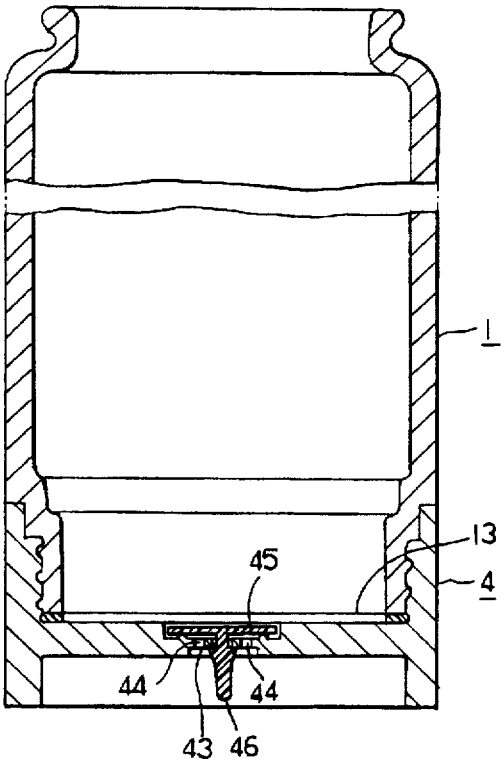
FIG. 4 (Prior Art)
FIG. 4 is a section view of the nursing bottle disclosed in U.S. Pat. No. 4,401,224.
Figure 5:
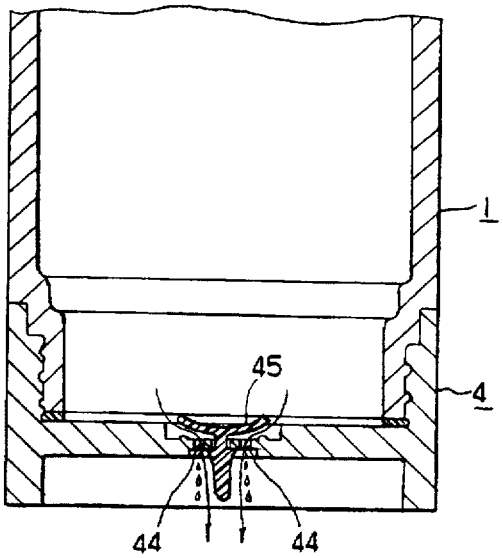
FIG. 5 (Prior Art)
FIG. 5 is an optional view of milk seeping out from the nursing bottle when preparing the milk as shown in FIG. 4.
Figure 6:
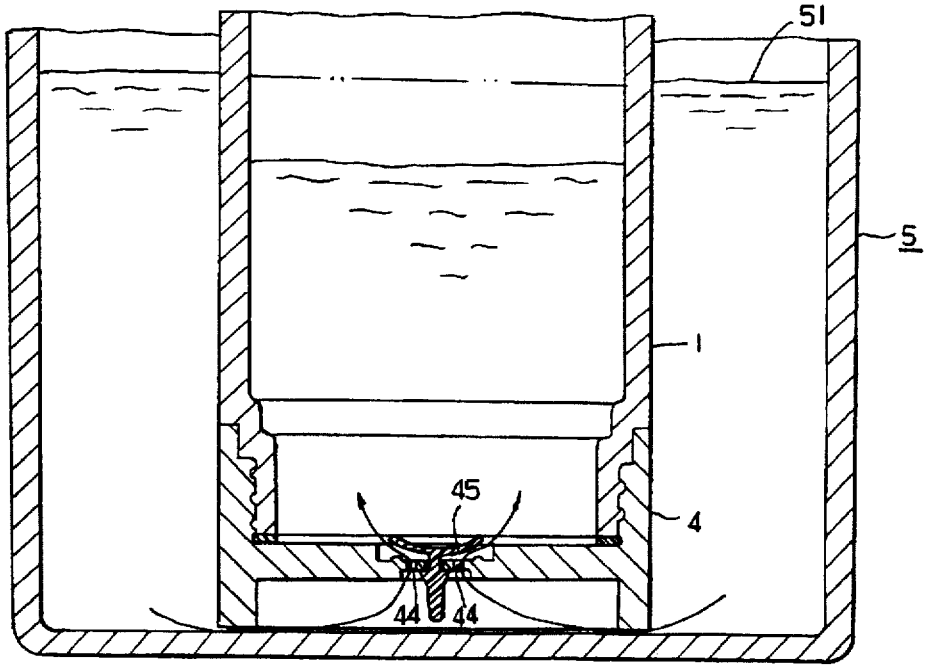
FIG. 6 (Prior Art)
FIG. 6 is an optional view of warm-keeping water infiltrating into the nursing bottle when keeping the bottle warm as shown in FIG. 4.

As shown in FIG. 7 through 13, the nursing bottle A according to the present invention remains comprising a bottle body 1, a bottle cap 2 and a nipple 3, wherein the nipple 3 is nested in the bottle cap 2 but the tip of nipple 3 is projected out for baby's sucking, a nipple hole 31 is provided at the tip of nipple 3 as an outflow hole of the milk in the nursing bottle; the bottle cap 2 and bottle body 1 are threaded onto or off each other through inner thread 21 and outer thread 11 provided thereon respectively; an opening 13 is provided at the bottom 12 of bottle body 1 of which the periphery is thread engaged with a lid 6 to be threaded onto or off through inner thread 61 and outer thread 14 provided thereon respectively, a diaphragm seat 62 with an arbor hole 63 and a plurality of air holes 64 is provided on the central part of the lid 6, a central arbor 66 of a unilateral diaphragm 65 can be inserted in the arbor hole 62 so as to dispose the unilateral diaphragm 65 on the inner side of the diaphragm seat 62 to cover the air holes 64 on the diaphragm seat 62 and close the inner sides of these air holes 64 but to open inward unilaterally in response to the baby's sucking power. The foregoing disposition of unilateral diaphragm 65 can let the baby suck milk comfortably and easily and make the milk flow smoothly.

The present invention is further essentially characterized in the following: an insert groove 67 is formed at the bottom surface of diaphragm seat 62 of the lid 6 of which one side is provided with a protective plate 7 extended to the bottom surface of lid 6, an insert ring 71 is provided in a position corresponding to the insert groove 67, the protective plate 7 can be turned open or closed on the bottom surface of lid 6 depending on the insert ring 71 is inserted in the insert groove 67 or not. The protective plate 7 is provided with an air inlet 72 and an air inlet. regulating device 73 which can regulate the size of air inlet 72 and close the air inlet 72 so as to let the air holes 64 on the lid 6 communicate with external space or not, and regulating the size of air inlet 72 can control the flow volume of air entering into the air holes 64 on the lid 6.

An interface plate 74 is provided at the middle higher section in the central position of protective plate 7, an upper recess 75 and a lower recess 76 are provided respectively above and below the interface plate 74, wherein the upper recess 75 is inside the insert ring 71, the foregoing air inlet 72 is formed through carving hollow about one half of the interface plate 74, a through hole 77 is provided at the center of interface plate 74 for a turning grip 78 passing through there upward, the inner end of turning grip 78 is provided with a covering plate 79 within about one half scope inside the upper recess 75, and the outer end thereof is in the lower recess 76. To turn the turning grip 78 can actuate the covering plate 79 to turn and move the covering plate 79 to gradually cover the air inlet 72 so as to control the opening and closing of air inlet 72 and regulate the size of air inlet 72. For instance, the covering plate 79 can be turned toward another side to not cover the air inlet 72 so as to keep the air inlet 72 in a full open state as shown in FIGS. 7 and 9, and the covering plate 79 can be turned to cover one half of the air inlet 72 so as to keep the air inlet 72 in a half open state as shown in FIG. 10; in addition, the covering plate 79 can be turned to cover the air inlet 72 as a whole so as to keep the air inlet 72 in a full closed state as shown in FIG. 8 and 11.

Figure 8:
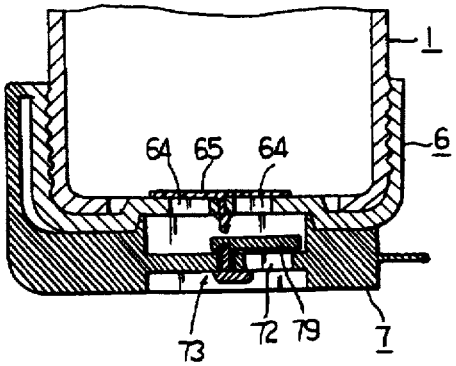
FIG. 8 is a partial section view of nursing bottle according to the present invention and shows the air inlet in a closed state.
Figure 11:
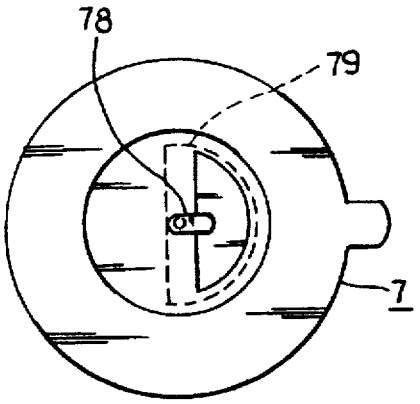
FIG. 11 is a bottom view of nursing bottle according to the present invention and shows the air inlet in a closed state.
Figure 12:
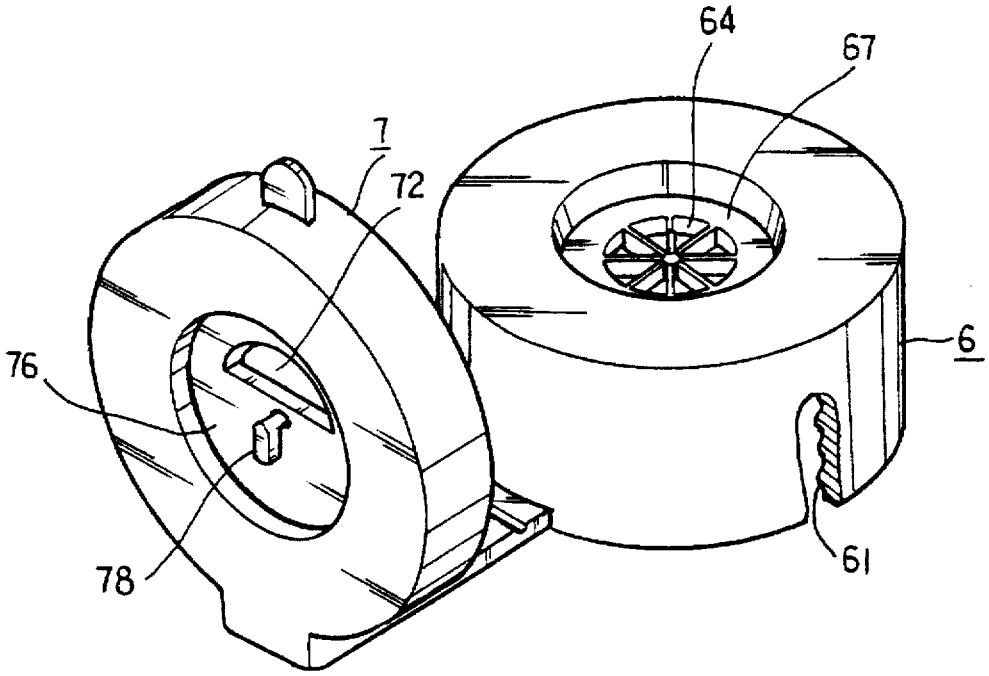
FIG. 12 is a bottom elevation view of nursing bottle according to the present invention.
Figure 13:
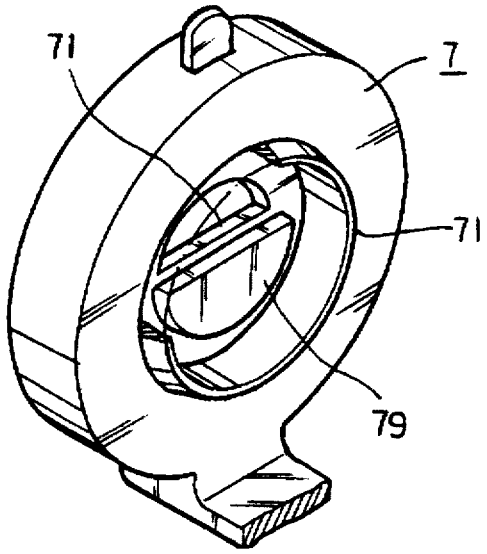
FIG. 13 is an elevation view of nursing bottle at another angle according to the present invention.

Therefore, as shown in FIGS. 8 and 11, the protective plate 7 can be disposed to cover the bottom surface of lid 6, and the air inlet 72 on the protective plate 7 can be regulated to be in a closed state, so the air holes 64 on the lid 6 are fully blocked from external structure to prevent the milk in the bottle from seeping our along these air holes 64 when preparing milk and to prevent the warm-keeping water or the impurity in the said water from infiltrating into the bottle when warming the milk.

Figure 7:
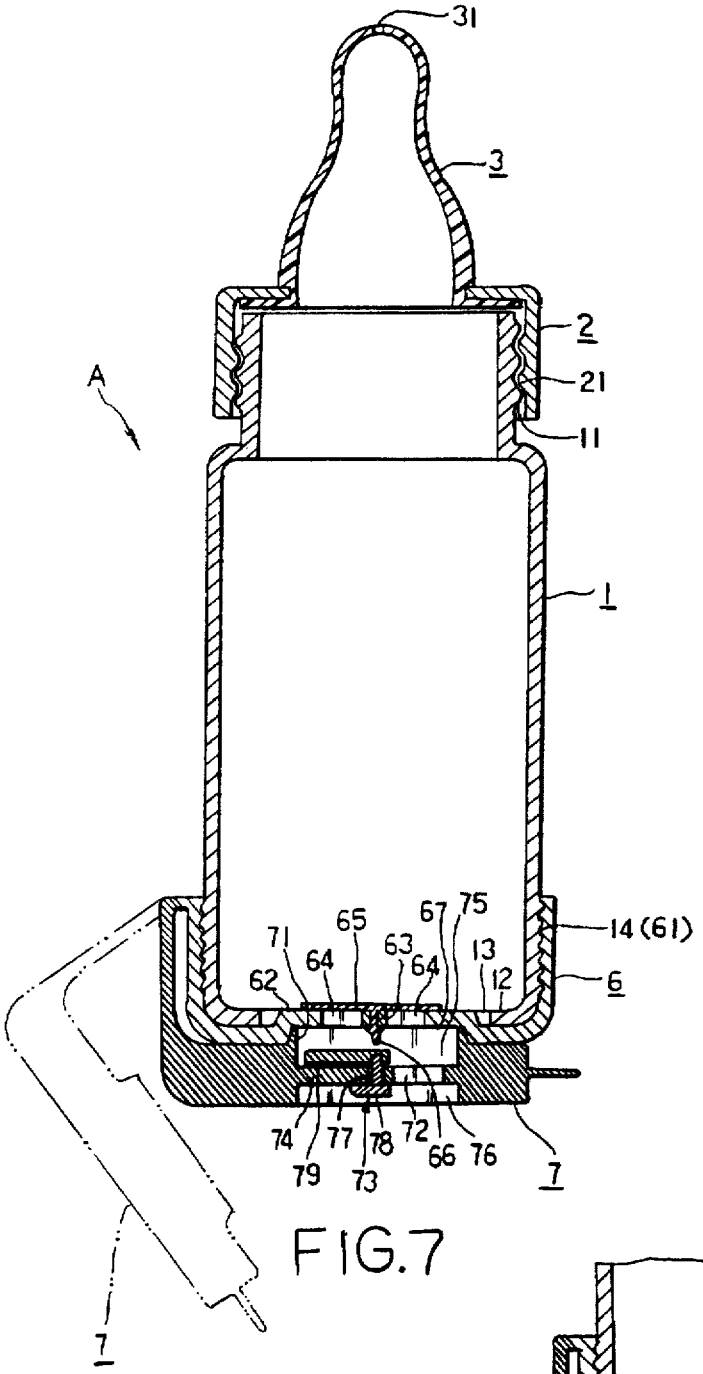
FIG. 7 is a section view of nursing bottle according to the present invention and shows the air inlet in an open state.
Figure 9:
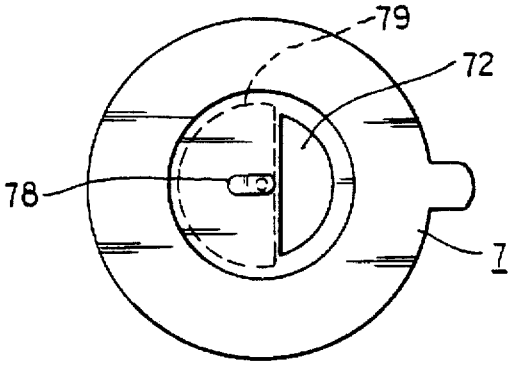
FIG. 9 is a bottom view of nursing bottle according to the present invention and shows the air inlet in a full open state.

When to let the baby hold the nipple 3 with its mouth for sucking the milk in the nursing bottle A, the air inlet 72 on the protective plate 7 can be opened as shown in FIGS. 7 and 9 so as to let the air holes 64 on the lid 6 communicate with the external space without affecting the air in the external space to enter into the bottle along these air holes 64 but to help the baby suck the milk in the bottle easily and smoothly.

Figure 10:
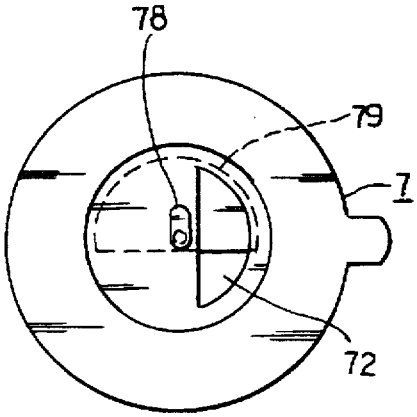
FIG. 10 is a bottom view of nursing bottle according to the present invention and shows the air inlet in a half open state.

In addition, the size of air inlet 72 can be regulated as shown in FIG. 10 so as to regulate the volume of air flow in keeping with the different sucking power of different babies who demand For different volume of air inflow.

Furthermore, when to clean the protective plate 7 and lid 6, the protective plate 7 can be turned open from the bottom surface of lid 6 as shown by the dotted lines in FIG. 7 so that the protective plate 7 and lid. 6 are in an open state in favor of cleaning them. Since the protective plate 7 is connected or installed on one side of the lid 6, there is no chance of losing the protective plate 7.

According to the present invention, a protective plate 7 is provided on the bottom surface of nursing bottle body 1 with an unilateral diaphragm 65 and can be turned open or closed, and an air inlet 72 and an air inlet regulating device 73 are provided on the protective plate 7 and can help the baby suck the milk easily and smoothly, fit the different babies who demand for different volume of air inflow and block the foreign matter or impurity from entering into the bottle and prevent the milk in the bottle from seeping out from the bottle. In view of the above, the use of the present invention is very practical and convenient.

I claim:

1. An improved baby bottle comprising:

a bottle body with an exterior threaded top end, a bottle cap with a threaded interior surface, and a nipple nested in said bottle cap, said nipple projects above said bottle cap; wherein said bottle cap is threaded onto said threaded top end of said bottle body, said bottle body includes an opening in a bottom end thereof, said bottom end includes a threaded periphery to receive a lid, a diaphragm seat with an arbor hole and a plurality of air holes is provided on a central portion of said lid such that a central arbor of a diaphragm is received in said arbor hole such that said diaphragm is disposed on an inner side of said diaphragm seat to cover said air holes, said diaphragm opens inward when a sucking force is applied to said nipple, an insert groove is formed in an outer surface of said diaphragm seat to receive an insert ring of a protective plate, said protective plate is attached to said lid by means of a flexible attaching member such that said protective plate swings away from said lid, and said protective plate includes an air inlet regulating device which regulates air flow into said bottle body, said air inlet regulating device comprises an interface plate disposed in a central portion of said protective plate, said interface plate contains an air inlet therein, a through hole is provided in said interface plate to receive a turning grip that passes through said interface plate, said turning grip includes a covering plate on an inner end thereof, and an outer end of said turning grip is exposed to an exterior of the baby bottle so that a user of the baby bottle can operate said turning grip to actuate said covering plate to cover a desired portion of said air inlet, thereby regulating air flow into the baby bottle.

* * * * *